US008226444B2

(12) United States Patent
Chow

(10) Patent No.: US 8,226,444 B2
(45) Date of Patent: Jul. 24, 2012

(54) MODULAR POWER STRIP

(75) Inventor: Chun Fai Chow, Hong Kong (HK)

(73) Assignee: Chun Hing Business Development Company Limited, Hong Kong (HK)

( * ) Notice: Subject to any disclaimer, the term of this patent is extended or adjusted under 35 U.S.C. 154(b) by 201 days.

(21) Appl. No.: 12/884,223

(22) Filed: Sep. 17, 2010

(65) Prior Publication Data

US 2011/0086542 A1 Apr. 14, 2011

(30) Foreign Application Priority Data

Oct. 12, 2009 (CN) ..... 2009 2 0244752 U

(51) Int. Cl.
*H01R 25/00* (2006.01)

(52) U.S. Cl. ..... 439/651

(58) Field of Classification Search ..... None
See application file for complete search history.

(56) References Cited

U.S. PATENT DOCUMENTS

| | | | | |
|---|---|---|---|---|
| 5,788,521 | A * | 8/1998 | Milan | 439/214 |
| 5,885,109 | A * | 3/1999 | Lee et al. | 439/652 |
| 6,573,617 | B2 * | 6/2003 | Jones et al. | 307/36 |
| 6,855,007 | B2 * | 2/2005 | Irish et al. | 439/614 |
| 7,140,922 | B2 * | 11/2006 | Luu et al. | 439/651 |
| 7,497,740 | B2 * | 3/2009 | Mei et al. | 439/652 |
| 2001/0027066 | A1 * | 10/2001 | Loh | 439/701 |

* cited by examiner

*Primary Examiner* — Vanessa Girardi

(57) ABSTRACT

A power strip has a power cord socket having a main electric receptacle provided on a face panel and a side electric receptacle provided on a stepped sidewall thereof, and an extension socket having a main electric receptacle provided on a face panel and a side electric plug provided an inverted stepped sidewall thereof, wherein the side electric plug is insertable into the side electric receptacle in a direction perpendicular to the base of the power cord socket, thereby connecting the extension socket to the power cord socket. The extension socket further includes an opposite stepped sidewall wherein two extension sockets can be connected together. The power strip includes an end piece with a plug insertable into the receptacle of the power cord socket or extension socket. Projection-and-groove and catch-and-trough engagements are formed on mating stepped sidewalls of the sockets and end piece.

20 Claims, 10 Drawing Sheets

MODULAR POWER STRIP

CROSS-REFERENCE TO RELATED APPLICATIONS

This application claims priority of Chinese patent application no. 200920244752.7 filed on Oct. 12, 2009, the entire content of which is hereby incorporated by reference.

FIELD OF PATENT APPLICATION

The present application relates generally to a power strip and particularly to a power strip formed of a plurality of connectable sockets.

BACKGROUND

In current technology, electrical appliances acquire electricity from indoor or outdoor sockets fixed on a wall or sockets connected to an extension cord. The purpose is to connect the power supply to the electrodes of the sockets by inserting the electric plugs of the electrical appliances into the sockets such that the plug electrodes can be in contact with the socket electrodes to supply electricity to the electrical appliances. The number of power outlets is normally fixed. However, in actual use, the number of power outlets needed may not be fixed. If the power outlets are insufficient, there will be a shortage of power outlet when extra power outlets are required for additional electrical appliances. An existing solution to this problem is to insert an electric plug of a first power strip into a remaining electric socket of the existing power outlet resource. If further power outlets are required, then one can insert the electric plug of a second power strip into a remaining electric socket of the first power strip. However, one disadvantage of this solution is that one electric socket is required to receive the electric plug of an additional power strip. This is a waste of the power outlet resource. Furthermore, this is a waste of space above and around the existing power outlets. Another disadvantage is that the connection between the existing power outlets and the additional power strip is not stable due to the fact that they are connected only by an electric plug at one end of the power strip.

The above description of the background is provided to aid in understanding a power strip, but is not admitted to describe or constitute pertinent prior art to the power strip disclosed in the present application, or consider any cited documents as material to the patentability of the claims of the present application.

SUMMARY

According to one aspect, there is provided a power strip formed of a plurality of connectable sockets. The power strip includes:

a power cord;

a first socket including a face panel, a base and a first stepped sidewall defined by a first step portion extending along the base, a main electric receptacle provided on the face panel, a side electric receptacle provided on a receptacle-carrying wall of the first step portion generally facing the same direction as the face panel, the main and side electric receptacles being electrically coupled to the power cord; and a second socket including a face panel, a base and a second stepped sidewall defined by a second step portion extending along the face panel of the second socket, the second stepped sidewall being formed at one side of the second socket in an inverted configuration with respect to the first stepped sidewall, a main electric receptacle provided on the face panel of the second socket, a side electric plug provided on a plug-carrying wall of the second step portion oppositely facing the face panel of the second socket, the side electric plug being electrically coupled to the main electric receptacle of the second socket,;

wherein the side electric plug of the second socket is insertable into the side electric receptacle of the first socket in a direction perpendicular to the base thereof, thereby connecting the first and second sockets together.

In one embodiment, the second socket further includes a third stepped sidewall defined by a third step portion extending along the base of the second socket and formed at another side of the second socket, a side electric receptacle provided on a receptacle-carrying wall of the third step portion generally facing the same direction as the face panel of the second socket, the side electric receptacle of the second socket being electrically coupled to the main electric receptacle of the second socket, and adapted to receive the side electric plug of another second socket.

In one embodiment, the power strip further includes a protective end piece, the protective end piece comprising a face panel, a base and a fourth stepped sidewall defined by a fourth step portion extending along the face panel of the protective end piece, the fourth stepped sidewall being formed in an inverted configuration with respect to the first or third stepped sidewall, a side plug provided on a plug-carrying wall of the fourth step portion oppositely facing the face panel of the protective end piece, the side plug of the protective end piece being insertable into the side electric receptacle of the first or second socket.

In one embodiment, each of the first and third stepped sidewalls has a first wall perpendicular to the base thereof, and each of the inverted second and fourth stepped sidewalls has a mating second wall perpendicular to the base connected thereto; wherein each of the first and third stepped sidewalls has a third wall perpendicular to the face panel thereof, and each of the inverted second and fourth stepped sidewalls has a mating fourth wall perpendicular to the face panel connected thereto; and wherein the first, second, third and fourth walls are parallel to each other.

In one embodiment, one of the first and second walls is provided with an elongated protrusion perpendicular to the base connected thereto, and the other one of the first and second walls is provided with an elongated groove perpendicular to the base connected thereto for slidable engagement with the elongated protrusion.

In one embodiment, one of the first and second walls is provided with a trough, and the other one of the first and second walls is provided with a projecting catch for insertion into and engagement with the trough.

In one embodiment, one of the third and fourth walls is provided with an elongated protrusion perpendicular to the face panel connected thereto, and the other one of the third and fourth walls is provided with an elongated groove perpendicular to the face panel connected thereto for slidable engagement with the elongated protrusion.

In one embodiment, the elongated protrusions and grooves have a generally rectangular cross section.

In one embodiment, the elongated protrusions and grooves have a generally dovetail-shaped cross section.

In one embodiment, the side electric plug is perpendicular to the plug-carrying wall of the second socket.

In one embodiment, the side electric plug of the second socket is a 2-prong electric plug, and the side electric receptacle of the first socket is a 2-prong electric receptacle.

In one embodiment, the side electric plug of the second socket is a 3-prong electric plug, and the side electric receptacle of the first socket is a 3-prong electric receptacle.

In one embodiment, prongs of the side electric plug of the second socket are arranged in a row along the plug-carrying wall, and corresponding openings of the side electric receptacle of the first socket are arranged in a row along the receptacle-carrying wall.

In one embodiment, the distance between the face panel of the first socket and the receptacle-carrying wall of the first socket is substantially the same as the distance between the face panel of the second socket and the plug-carrying wall of the second socket, and the distance between the receptacle-carrying wall of the first socket and the base of the first socket is substantially the same as the distance between the plug-carrying wall of the second socket and the base of the second socket.

In one embodiment, the face panels of the first and second sockets are disposed on a same plane when the first and second sockets are connected together.

In one embodiment, each of the first and second sockets has a power switch.

In one embodiment, each of the first and second sockets has a neon tube power indicator.

According to another aspect, there is provided a power strip including:

a first socket including a face panel, a base and a first stepped sidewall defined by a first step portion extending along the base, a main electric receptacle provided on the face panel, a first electric connector provided on the first stepped sidewall, the main electric receptacle and the first electric connector being electrically coupled to a power cord; and a second socket including a face panel, a base and a second stepped sidewall defined by a second step portion extending along the face panel of the second socket, the second stepped sidewall being formed at one side of the second socket in an inverted configuration with respect to the first stepped sidewall, a main electric receptacle provided on the face panel of the second socket, a second electric connector provided on the second stepped sidewall, the second electric connector being electrically coupled to the main electric receptacle of the second socket, and connectable to the first electric connector of the first socket.

In one embodiment, the second socket further includes a third stepped sidewall defined by a third step portion extending along the base of the second socket and formed at another side of the second socket, a third electric connector provided on the third stepped sidewall, the third electric connector being electrically coupled to the main electric receptacle of the second socket, and connectable to the second electric connector of another second socket.

In one embodiment, the power strip further includes a protective end piece having a face panel, a base and a fourth stepped sidewall defined by a fourth step portion extending along the face panel of the protective end piece, the fourth stepped sidewall being formed in an inverted configuration with respect to the first or third stepped sidewall, a fourth connector provided on the fourth stepped sidewall, and connectable to the first electric connector of the first socket or the third electric connector of the second socket.

In one embodiment, the first electric connector is an electric receptacle provided on a receptacle-carrying wall of the first step portion generally facing the same direction as the face panel of the first socket, the second electric connector is an electric plug provided on a plug-carrying wall of the second step portion oppositely facing the face panel of the second socket, the third electric connector is an electric receptacle provided on a receptacle-carrying wall of the third step portion generally facing the same direction as the face panel of the second socket, and the fourth electric connector is a plug provided on a plug-carrying wall of the fourth step portion oppositely facing the face panel of the protective end piece, wherein the electric plug of the second socket and the plug of the protective end piece are insertable into the electric receptacle of the first or second sockets in a direction perpendicular to the base thereof.

In one embodiment, each of the first and third stepped sidewalls has a first wall perpendicular to the base connected thereto, and each of the inverted second and fourth stepped sidewalls has a mating second wall perpendicular to the base connected thereto; wherein each of the first and third stepped sidewalls has a third wall perpendicular to the face panel connected thereto, and each of the inverted second and fourth stepped sidewalls has a mating fourth wall perpendicular to the face panel connected thereto; and wherein the first, second, third and fourth walls are parallel to each other.

In one embodiment, one of the first and second walls is provided with an elongated protrusion perpendicular to the base connected thereto, and the other one of the first and second walls is provided with an elongated groove perpendicular to the base connected thereto for slidable engagement with the elongated protrusion.

In one embodiment, one of the first and second walls is provided with a trough, and the other one of the first and second walls is provided with a projecting catch for insertion into and engagement with the trough.

In one embodiment, one of the third and fourth walls is provided with an elongated protrusion perpendicular to the face panel connected thereto, and the other one of the third and fourth walls is provided with an elongated groove perpendicular to the face panel connected thereto for slidable engagement with the elongated protrusion.

In one embodiment, the elongated protrusions and grooves have a generally rectangular cross section.

In one embodiment, the elongated protrusions and grooves have a generally dovetail-shaped cross section.

In one embodiment, the side electric plug is perpendicular to the plug-carrying wall of the second socket.

In one embodiment, the side electric plug of the second socket is a 2-prong electric plug, and the side electric receptacle of the first socket is a 2-prong electric receptacle.

In one embodiment, the side electric plug of the second socket is a 3-prong electric plug, and the side electric receptacle of the first socket is a 3-prong electric receptacle.

In one embodiment, prongs of the side electric plug of the second socket are arranged in a row along the plug-carrying wall, and corresponding openings of the side electric receptacle of the first socket are arranged in a row along the receptacle-carrying wall.

In one embodiment, the distance between the face panel of the first socket and the receptacle-carrying wall of the first socket is substantially the same as the distance between the face panel of the second socket and the plug-carrying wall of the second socket, and the distance between the receptacle-carrying wall of the first socket and the base of the first socket is substantially the same as the distance between the plug-carrying wall of the second socket and the base of the second socket.

In one embodiment, the face panels of the first and second sockets are disposed on a same plane when the first and second sockets are connected together.

In one embodiment, each of the first and second sockets has a power switch.

In one embodiment, each of the first and second sockets has a neon tube power indicator.

According to yet another aspect, there is provided a socket kit for building a power strip. The socket kit including:

a power cord socket including a face panel, a base and a first stepped sidewall defined by a first step portion extending along the base, a main electric receptacle provided on the face panel, a first electric connector provided on the first stepped sidewall, the main electric receptacle and the first electric connector being electrically coupled to a power cord; and a extension socket including a face panel, a base and a second stepped sidewall defined by a second step portion extending along the face panel of the extension socket, the second stepped sidewall being formed at one side of the extension socket in an inverted configuration with respect to the first stepped sidewall, a main electric receptacle provided on the face panel of the extension socket, a second electric connector provided on the second stepped sidewall, the second electric connector being electrically coupled to the main electric receptacle of the extension socket, and connectable to the first electric connector of the power cord socket.

In one embodiment, the extension socket further includes a third stepped sidewall defined by a third step portion extending along the base of the extension socket and formed at another side of the extension socket, a third electric connector provided on the third stepped sidewall, the third electric connector being electrically coupled to the main electric receptacle of the extension socket, and connectable to the second electric connector of another extension socket.

In one embodiment, the socket kit further includes a protective end piece comprising a face panel, a base and a fourth stepped sidewall defined by a fourth step portion extending along the face panel of the protective end piece, the fourth stepped sidewall being formed in an inverted configuration with respect to the first or third stepped sidewall, a fourth connector provided on the fourth stepped sidewall, and connectable to the first electric connector of the power cord socket or the third electric connector of the extension socket.

In one embodiment, the first electric connector is an electric receptacle provided on a receptacle-carrying wall of the first step portion generally facing the same direction as the face panel of the power cord socket, the second electric connector is an electric plug provided on a plug-carrying wall of the second step portion oppositely facing the face panel of the extension socket, the third electric connector is an electric receptacle provided on a receptacle-carrying wall of the third step portion generally facing the same direction as the face panel of the extension socket, and the fourth electric connector is a plug provided on a plug-carrying wall of the fourth step portion oppositely facing the face panel of the protective end piece, wherein the electric plug of the extension socket and the plug of the protective end piece are insertable into the electric receptacle of the power cord socket or extension socket in a direction perpendicular to the base thereof.

In one embodiment, each of the first and third stepped sidewalls has a first wall perpendicular to the base connected thereto, and each of the inverted second and fourth stepped sidewalls has a mating second wall perpendicular to the base connected thereto; wherein each of the first and third stepped sidewalls has a third wall perpendicular to the face panel connected thereto, and each of the inverted second and fourth stepped sidewalls has a mating fourth wall perpendicular to the face panel connected thereto; and wherein the first, second, third and fourth walls are parallel to each other.

In one embodiment, one of the first and second walls is provided with an elongated protrusion perpendicular to the base connected thereto, and the other one of the first and second walls is provided with an elongated groove perpendicular to the base connected thereto for slidable engagement with the elongated protrusion.

In one embodiment, one of the first and second walls is provided with a trough, and the other one of the first and second walls is provided with a projecting catch for insertion into and engagement with the trough.

In one embodiment, one of the third and fourth walls is provided with an elongated protrusion perpendicular to the face panel connected thereto, and the other one of the third and fourth walls is provided with an elongated groove perpendicular to the face panel connected thereto for slidable engagement with the elongated protrusion.

In one embodiment, each of the power cord socket and extension socket has a power switch.

In one embodiment, each of the power cord socket and extension socket has a neon tube power indicator.

Although the power strip disclosed in the present application is shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments of the power strip disclosed in the present application will now be described by way of example with reference to the accompanying drawings.

DETAILED DESCRIPTION

Reference will now be made in detail to a preferred embodiment of the power strip disclosed in the present application, examples of which are also provided in the following description. Exemplary embodiments of the power strip disclosed in the present application are described in detail, although it will be apparent to those skilled in the relevant art that some features that are not particularly important to an understanding of the power strip may not be shown for the sake of clarity.

Furthermore, it should be understood that the power strip disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the appended claims It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

First Embodiment

Figure 1:
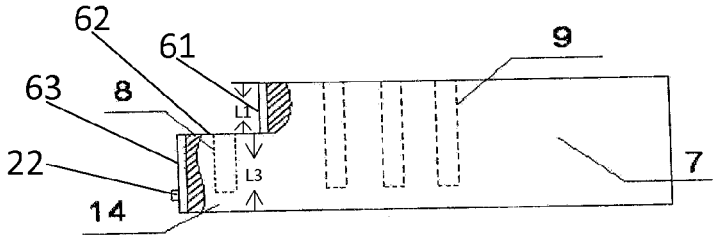
FIG. 1 is a side view of a first embodiment of a power cord socket of an electrical power strip disclosed in the present application.
Figure 2:
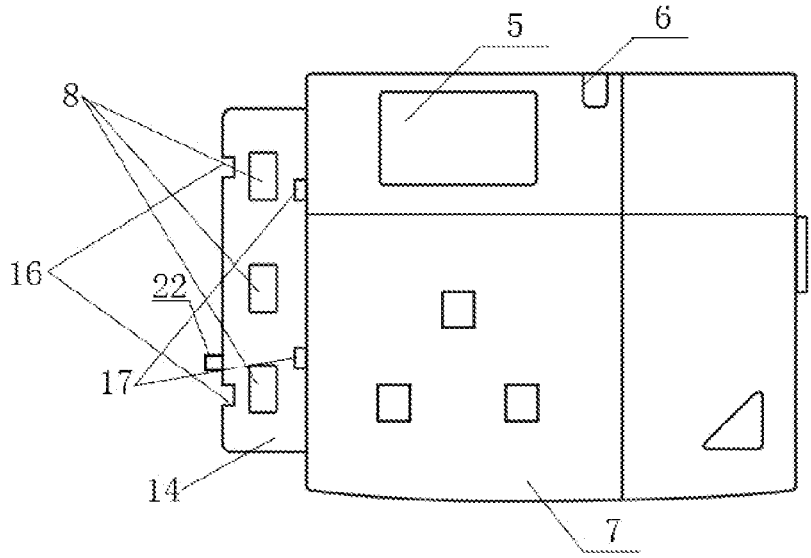
FIG. 2 is a top view of the first embodiment of the power cord socket.
Figure 3:
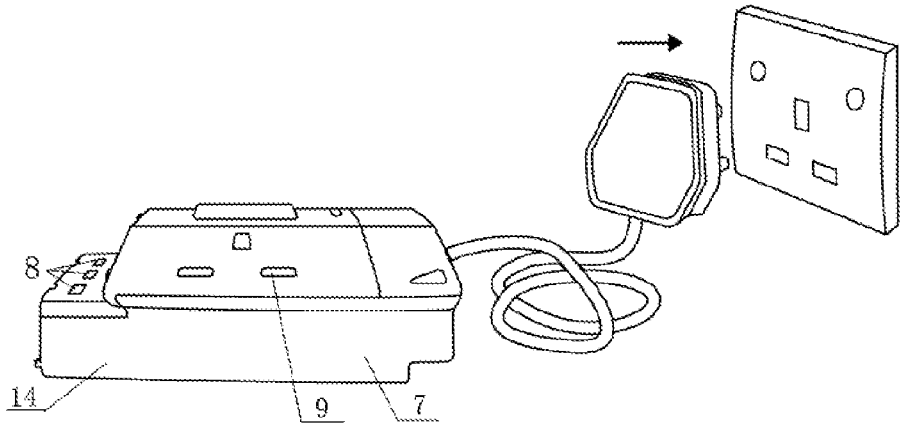
FIG. 3 is a perspective view of the first embodiment of the power cord socket.

FIGS. 1-7 show a power strip according a first embodiment disclosed in the present application. The power strip may include a power cord socket 7 connected to a power cord and an extension socket 11. As illustrated in FIGS. 1-3, the power cord socket 7 may include a main electric receptacle 9 (with electrode) provided on a face panel of the power cord socket 7. The main electric receptacle 9 can be any standard electric receptacle for receiving standard electric plugs made according to the British standard, the American standard, the Chinese standard or any other standards of other countries.

The power cord socket 7 can have a first stepped sidewall defined by a first step portion 14 extending from a side of the power cord socket 7 along a base thereof. The first step portion 14 can be integrally formed with the power cord socket 7. A side electric receptacle 8 may be provided on a receptacle-carrying wall 62 generally facing the same direction as the face panel. The main and side electric receptacles 9, 8 can be electrically coupled to the power cord and in turn connected to a power source. Insulation sleeves (not shown) may be integrally formed within the side electric receptacle 8. According to the illustrated embodiment, the side electric receptacle 8 is a 3-prong electric receptacle. The three openings of the 3-prong electric receptacle 8 can be arranged in a row along the receptacle-carrying wall 62 of the power cord socket 7.

Figure 4:
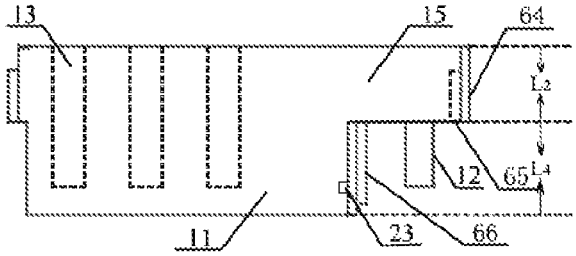
FIG. 4 is a side view of a first embodiment of an extension socket.
Figure 5:
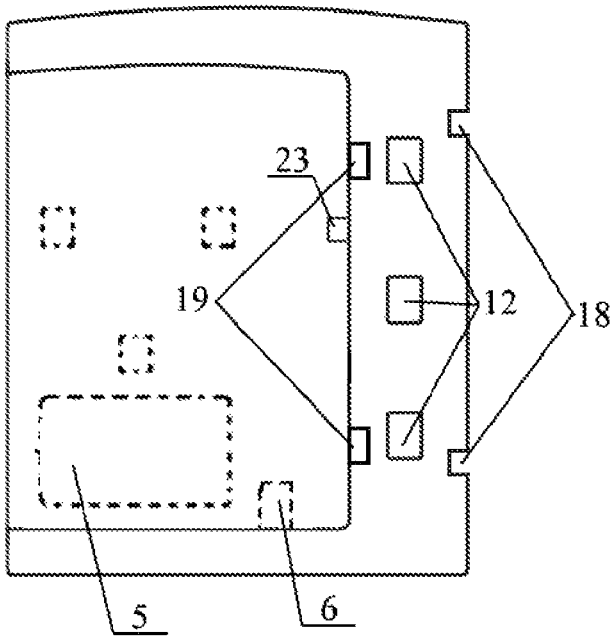
FIG. 5 is a top view of the first embodiment of the extension socket.
Figure 6:
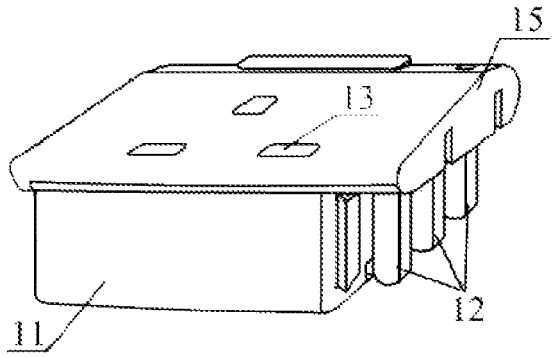
FIG. 6 is a perspective view of the first embodiment of the extension socket.

As shown in FIGS. 4, 5 and 6, the extension socket 11 is provided with a main electric receptacle 13. The extension socket 11 may have a second stepped sidewall defined by a second step portion 15 extending from a side of the extension socket 11 along a face panel thereof. The second stepped sidewall is oriented in an inverted configuration with respect to the first stepped sidewall. The second step portion 15 can be integrally formed with the extension socket 11. A side electric plug 12 may be provided on a plug-carrying wall 65 oppositely facing the face panel of the extension socket 11. The side electric plug 12 of the extension socket 11 can be electrically coupled to the main electric receptacle 13 of the extension socket 11. According to the illustrated embodiment, the side electric plug 12 is a three-prong electric plug. The three prongs may be arranged in a row along the plug-carrying wall 65 of the extension socket 11 so that the side electric plug 12 can have a relatively flat profile as compared to a standard three-prong electric plug in which the three prongs are arranged in a triangle. This can reduce the length of the power strip so formed by the power cord socket 7 and the extension sockets 11, and can reduce space occupied by the power strip.

Although it has been shown and described that there is only one standard electric receptacle provided on each of the power cord socket 7 and the extension sockets 11 for receiving one standard electric plug, it is contemplated that two or more standard electric receptacles can be provided on each of the power cord socket 7 and the extension sockets 11.

Furthermore, although it has been shown and described that the side electric receptacle 8 is provided on the power cord socket 7 and the side electric plug 12 is provided on the extension socket 11, it is appreciated that the side electric plug 12 can be provided on the power cord socket 7 and the side electric receptacle 8 can be provided on the extension socket 11 instead.

Figure 7:
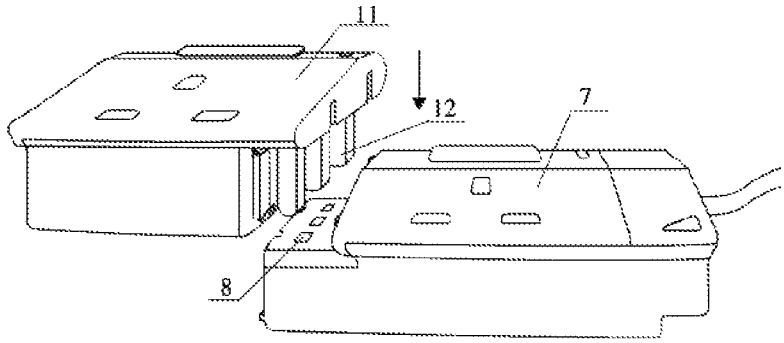
FIG. 7 is a perspective view showing the coupling of the power cord socket and the extension socket according to the first embodiment disclosed in the present application.
Figure 8A:
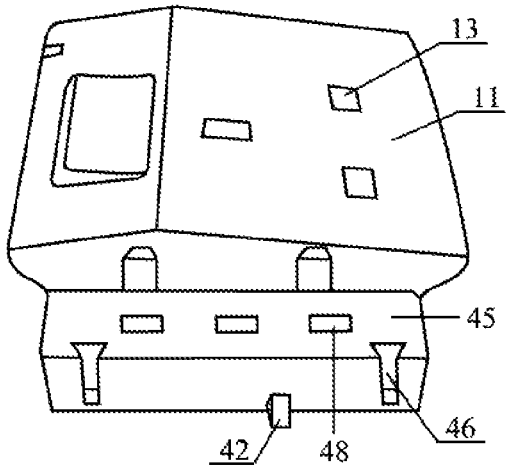
FIG. 8A is a side perspective view of a second embodiment of the extension socket.
Figure 8B:
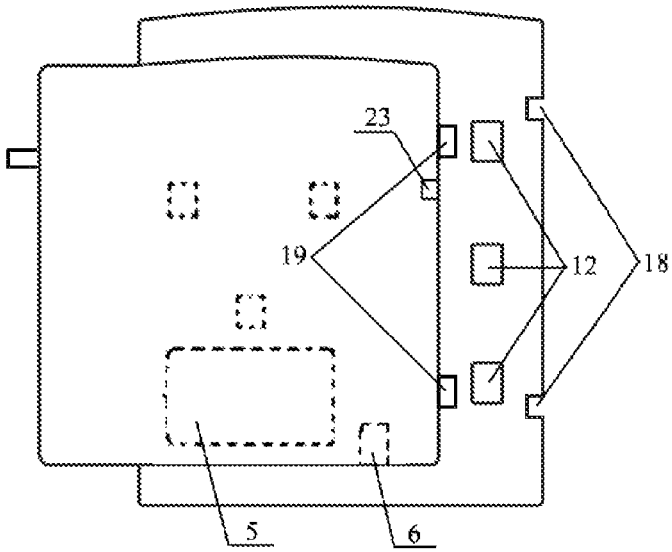
FIG. 8B is a top view of the second embodiment of the extension socket.
Figure 8C:
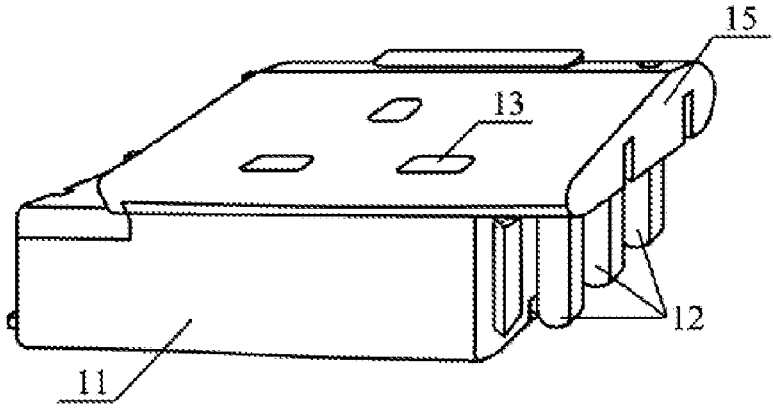
FIG. 8C is a perspective view of the second embodiment of the extension socket.
Figure 8D:
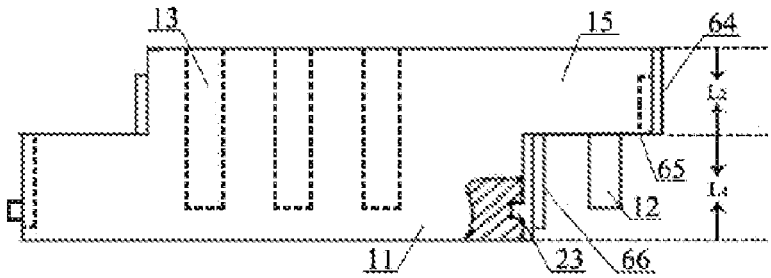
FIG. 8D is a side view of the second embodiment of the extension socket.
Figure 9:
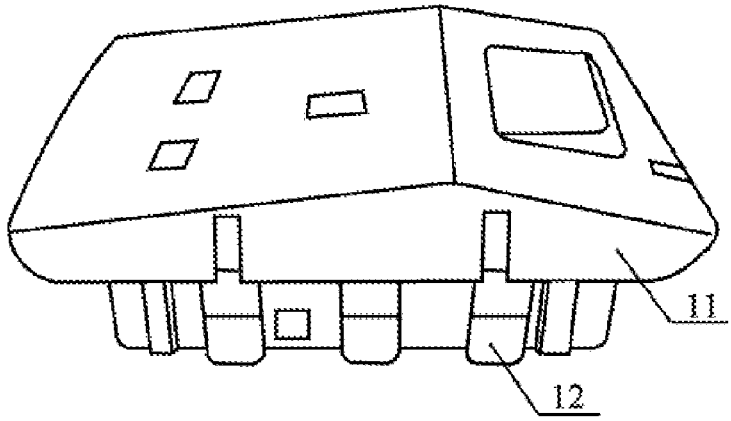
FIG. 9 is another side perspective view of the second embodiment of the extension socket.
Figure 10:
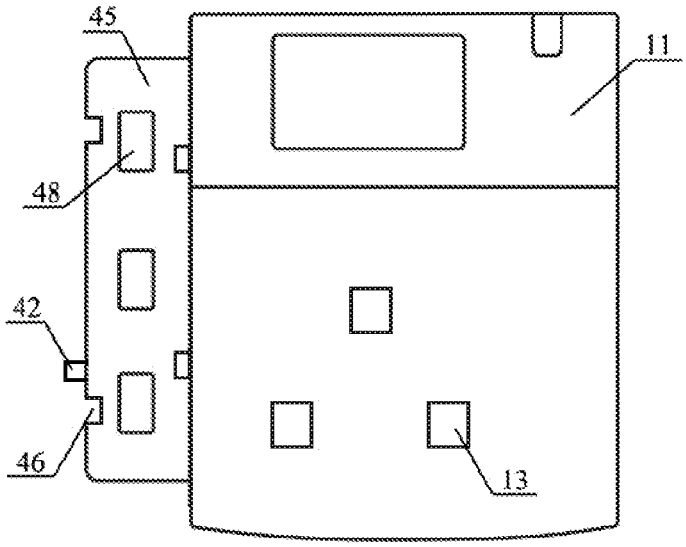
FIG. 10 is a top perspective view of the second embodiment of the extension socket.
Figure 11:
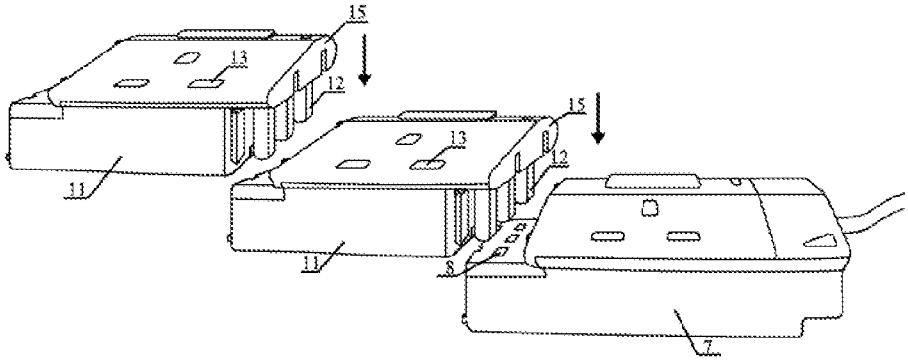
FIG. 11 is a perspective view showing the coupling of the power cord socket and the extension socket according to the second embodiment disclosed in the present application.

FIG. 7 shows the connection of the power cord socket 7 and the extension socket 11. To connect, the side electric plug 12 of the extension socket 11 is plugged into the side electric receptacle 8 of the power cord socket 7 in a vertical direction perpendicular to the base of the power cord socket 7. When the side electric plug 12 of the extension socket 11 is plugged into the side electric receptacle 8 of the power cord socket 7, the inverted second stepped sidewall of the extension socket 11 mates with the first stepped sidewall of the power cord socket 7. The power cord socket 7 and the extension socket 11 cannot be easily disengaged. This can enhance the stability of the connection of the power cord socket 7 and the extension socket 11 and maintain the safety of the power strip.

The height of the power cord socket 7 and the height of the extension socket 11 can be the same. As shown in FIGS. 1 and 4, the height L1 of the vertical sidewall 61 of the power cord socket 7 (i.e. the distance between the face panel and the receptacle-carrying wall 62 of the power cord socket 7) is substantially the same as the height L2 of the second step portion 15 of the extension socket 11 (i.e. the distance between the face panel and the plug-carrying wall 65 of the extension socket 11). Furthermore, the height L3 of the first step portion 14 of the power cord socket 7 (i.e. the distance between the receptacle-carrying wall 62 and the base of the power cord socket 7) is substantially the same as the height L4 of the sidewall 66 of the extension socket 11 (i.e. the distance between the plug-carrying wall 65 and the base of the extension socket 11). Hence, the face panels of the power cord socket 7 and extension socket 11 can be disposed on a same plane or level when the power cord socket 7 and extension socket 11 are coupled together. This can result in a unitary and neat outer appearance of the power strip.

Although it has been shown and described that the face panel of the power cord socket 7 and the face panel of the extension socket 11 are disposed in a same plane or level, it is understood that the face panel of the power cord socket 7 may be higher or lower than the face panel of the extension socket 11.

In addition, the first and second sidewalls of the power cord socket 7 and the extension socket 11 may be formed with engaging elements for holding the power cord socket 7 and extension socket 11 together.

As shown in FIGS. 1-6, a projection or catch 22 may be formed on a vertical wall 63 of the first stepped sidewall perpendicular to the base of the power cord socket 7, and a corresponding recess or trough 23 may be formed on a mating vertical wall 66 of the second stepped sidewall perpendicular to the base of the extension socket 11. The catch 22 can be in the form of a spring-biased catch having an inner spring for biasing the catch 22 in the outwardly extending position. It is understood by one skilled in the art that the catch 22 and trough 23 can be provided in any other suitable mating surfaces of the power cord socket 7 and extension socket 11.

Furthermore, the power cord socket 7 and extension socket 11 can be connected together by slidable engagements. According to the illustrated embodiment, two vertical elongated grooves 16 can be formed on the vertical wall 63 of the first stepped sidewall of the power cord socket 7, and two corresponding vertical elongated protrusions 19 can be formed on the vertical wall 66 of the second stepped sidewall of the extension socket 11. When the side electric plug 12 of the extension socket 11 is inserted into the side electric receptacle 8 of the power cord socket 7 in a vertical direction perpendicular to the base of the power cord socket 7, the two vertical protrusions 19 of the extension socket 11 slide into the two corresponding vertical grooves 16 of the power cord socket 7 thereby holding the power cord socket 7 and extension socket 11 together in a predetermined position.

The grooves 16 and the protrusions 19 can facilitate the connection of the power cord socket 7 and the extension socket 11 by positioning the extension socket 11 at a right position above the power cord socket 7. When the power cord socket 7 and extension socket 11 are connected, the engaged grooves 16 and protrusions 19 help to prevent the power cord socket 7 and the extension socket 11 from disengagement. The elongated grooves 16 and the elongated protrusions 19 may have a generally rectangular cross section or a generally dovetail-shaped cross section.

Although it has been shown and described that there are two vertical grooves 16 formed on the power cord socket 7 and two vertical protrusions 19 formed on the extension socket 11, it is understood by one skilled in the art that the number, the position and the shape of the grooves 16 and protrusions 19 may vary so long as the engagement of the grooves 16 and the protrusions 19 is sufficient to hold the power cord socket 7 and the extension socket 11 together in a desired position.

Furthermore, two vertical elongated protrusions 17 can be formed on the vertical wall 61 of the first stepped sidewall perpendicular to the face panel of the power cord socket 7, and two corresponding vertical elongated grooves 18 can be formed on the vertical wall 64 of the second stepped sidewall perpendicular to the face panel of the extension socket 11. When the side electric plug 12 of the extension socket 11 is inserted into the side electric receptacle 8 of the power cord socket 7 in a vertical direction perpendicular to the base of the power cord socket 7, the two corresponding vertical protrusions 17 of the power cord socket 7 slide into the two vertical grooves 18 of the extension socket 11, thereby further holding the power cord socket 7 and extension socket 11 together.

The grooves 18 and the protrusions 17 can further facilitate the connection of the power cord socket 7 and the extension socket 11. When the power cord socket 7 and extension socket 11 are connected, the engaged grooves 18 and protrusions 17 further prevent the power cord socket 7 and the extension socket 11 from disengagement. The elongated grooves 18 and the elongated protrusions 17 may have a generally rectangular cross section or a generally dovetail-shaped cross section.

Although it has been shown and described that there are two vertical protrusions 17 formed on the power cord socket 7 and two corresponding vertical grooves 18 formed on the extension socket 11, it is understood by one skilled in the art that the number, the position and the shape of the grooves 18 and protrusions 17 may vary so long as the engagement of the grooves 18 and the protrusions 17 is sufficient to hold the power cord socket 7 and the extension socket 11 together in a desired position.

As depicted in FIGS. 2, 3, 5 and 6, a power switch 5 may be provided on each of the power cord socket 7 and extension socket 11. The power switches 5 are employed to control electric power to the electrodes of the main electric receptacles 9, 13 of the power cord socket 7 and extension socket 11. A neon tube power indicator 6 may be provided on the power cord socket 7 to indicate the power condition of the main electric receptacle 9 of the power cord socket 7. Similarly, another neon tube power indicator 6 may also be provided on the extension socket 11 to indicate the power condition of the main electric receptacle 13 of the extension socket 11. It is understood that any other conventional lighting device such as light-emitting diode can be used as the power indicator.

As depicted in FIG. 7, one can insert the side electric plug 12 of the extension socket 11 into the side electric receptacle 8 of the power cord socket 7 in a vertical direction (as shown by the arrow) perpendicular to the base of the power cord socket 7, thereby mechanically and electrically connect the power cord socket 7 and extension socket 11 together in order to increase the number of main electric receptacles in the power strip. It can be realized that the extension socket 11 does not occupy the main electric receptacle 9 of the power cord socket 7. This can increase the number of main electric receptacles without wasting the outlet resources of the power strip. Since the side electric plug 12 of the extension socket 11 is inserted into the side electric receptacle 8 of the power cord socket 7 in a vertical direction, the power cord socket 7 and extension socket 11 cannot be separated easily. This can enhance the stability of the mechanical structure of the connected sockets. The employment of the catch 22 and trough 23 can further enhance the stability of the mechanical structure of the connected sockets and can further prevent disengagement of the power cord socket 7 and extension socket 11.

Second Embodiment

As shown in FIGS. 8A, 8B, 8C, 8D and 9-11, the opposite side of the extension socket 11 can be provided with a third stepped sidewall defining a third step portion 45 extending from another side of the extension socket 11 along a base thereof. The third step portion 45 can be integrally formed with the extension socket 11. A side electric receptacle 48 may be provided on a receptacle-carrying wall of the third step portion 45 generally facing the face panel of the extension socket 11. The side electric receptacle 48 can be electrically coupled to the main electric receptacle 13.

According to the illustrated embodiment, the side electric receptacle 48 is a 3-prong electric receptacle. The three openings of the 3-prong electric receptacle can be arranged in a row along the receptacle-carrying wall of the third step portion 45.

According to the second embodiment, the extension socket 11 can be connected to another extension socket 11. To connect, the side electric plug 12 of the extension socket 11 is plugged into the side electric receptacle 48 of another extension socket 11 in a vertical direction perpendicular to the base thereof. When the side electric plug 12 of the extension socket 11 is plugged into the side electric receptacle 48 of another extension socket 11, the inverted second stepped sidewall of the extension socket 11 mates with the third stepped sidewall of the other extension socket 11. Hence, the two connected extension sockets 11 cannot be easily separated. It is understood that two or more extension sockets 11 can be connected together if necessary to form a longitudinally extending power strip.

Similarly, the second and third stepped sidewalls can be provided with elongated protrusions and elongated grooves. This can reduce the chance of disengagement of the two extension sockets 11. According to the illustrated embodiment, two elongated protrusions 19 are provided on the second stepped sidewall and two elongated grooves 46 are provided on the third stepped sidewall.

Although it has been shown and described that elongated protrusions are provided on the second stepped sidewall and corresponding elongated grooves are provided on the third stepped sidewall, it is understood that elongated grooves may be provided on the second stepped sidewall and corresponding elongated protrusions may be provided on the third stepped sidewall, or elongated groove and protrusion are provided on the second stepped sidewall and corresponding elongated protrusion and groove are provided on the third stepped sidewall.

A catch 42 may be formed on a vertical wall of the third stepped sidewall of the extension socket 11 for engagement with the corresponding trough 23 formed on the vertical wall 66 of the second stepped sidewall of the extension socket 11 when two extension sockets 11 are connected together. The catch 42 can be in the form of a spring-biased catch having an inner spring for biasing the catch 42 in the outwardly extending position.

Although it has been shown and described that the second and third stepped sidewalls are formed on two opposite sides of the extension socket 11, it is appreciated that the third stepped sidewall can be located at an adjacent side of the second stepped sidewall.

Third Embodiment

Figure 12:
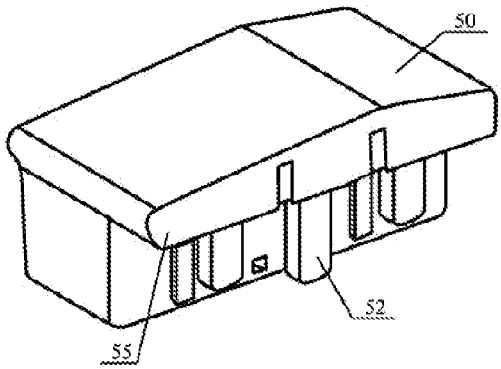
FIG. 12 is a perspective view of a protective end piece according to a third embodiment.

As shown in FIG. 12, the power strip may further include a protective end piece 50. The protective end piece 50 may include a face panel, a base and a fourth stepped sidewall defining a fourth step portion 55 extending along the face panel thereof. The protective end piece 50 is not provided with any electric receptacle, and is therefore entirely insulated.

The fourth stepped sidewall is oriented in an inverted configuration with respect to the first and third stepped sidewalls. The fourth step portion 55 can be integrally formed with the protective end piece 50. A side plug 52 may be provided on a plug-carrying wall oppositely facing the face panel of the protective end piece 50. According to the illustrated embodiment, the side plug 52 is a three-prong plug. The three prongs may be arranged in a row along the plug-carrying wall of the protective end piece 50 so that the side plug 52 can have a relatively flat profile as compared to a standard three-prong electric plug in which the three prongs are arranged in a triangle. The protective end piece 50 is insertable into the side electric receptacle 8 of the power cord socket 7 or the side electric receptacle 48 of the extension socket 11 in a direction perpendicular to the base thereof. This can enhance the stability of the connection of the protective end piece 50 to the power cord socket 7 or the extension socket 11. The protective end piece 50 also serves to produce an anti-thunder effect for the power strip.

Figure 13:
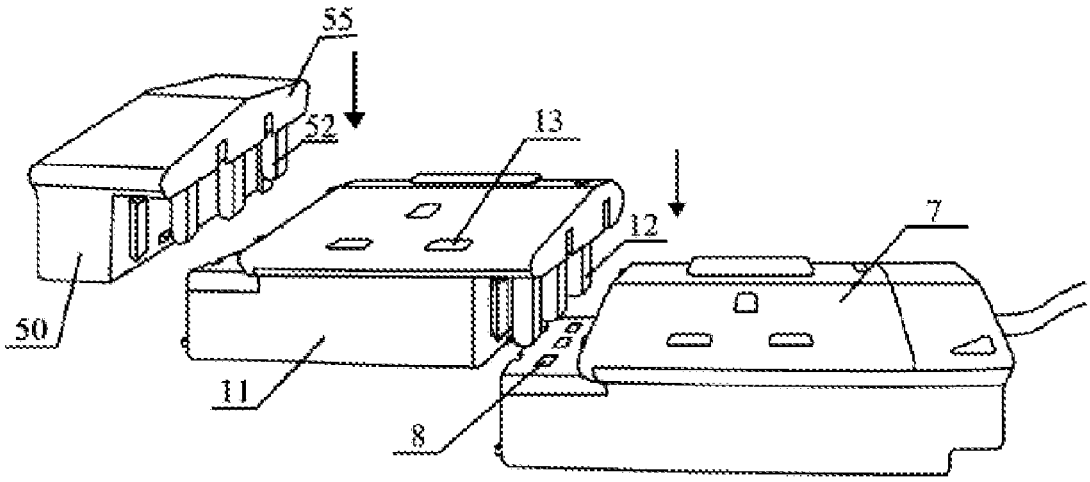
FIG. 13 is a perspective view showing the coupling of the power cord socket, the extension socket and the protective end piece according to the third embodiment disclosed in the present application.

As illustrated in FIG. 13, the protective end piece 50 can be inserted into the last extension socket 11 of one of more extension sockets 11 being connected to the power cord socket 7. The power strip so formed can be unitary in appearance and entirely insulated.

Similarly, the fourth stepped sidewall of the protective end piece 50 may be formed with engaging elements for holding the protective end piece 50 to the power cord socket 7 or the extension socket 11.

Figure 14:
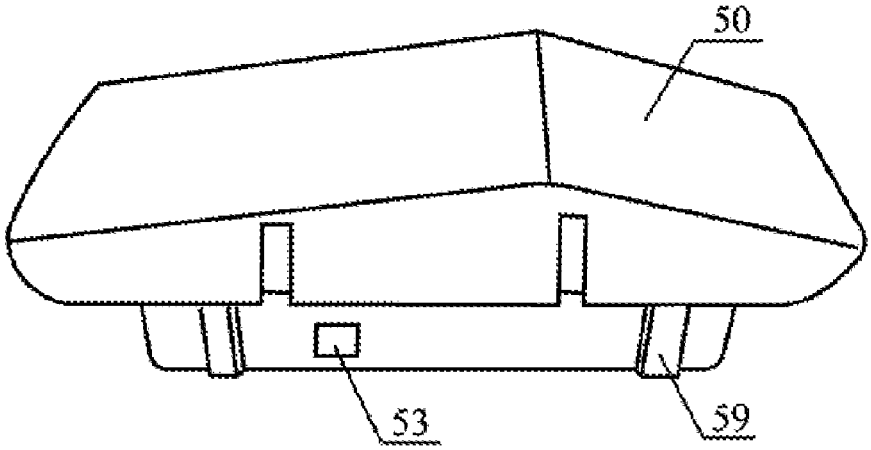
FIG. 14 is a perspective view of another protective end piece.
Figure 15:
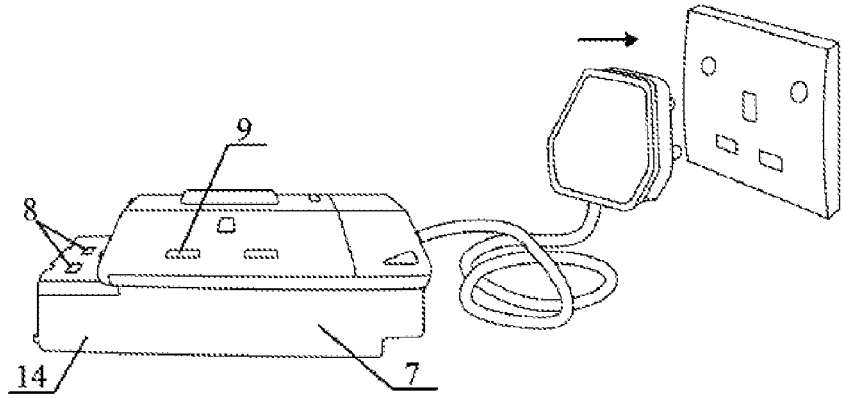
FIGS. 15-23 show a fourth embodiment of the power strip.
Figure 16A:
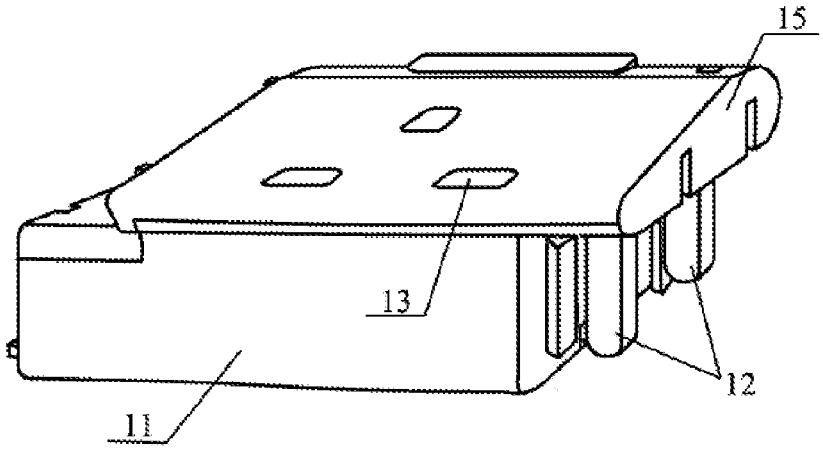
Figure 16B:
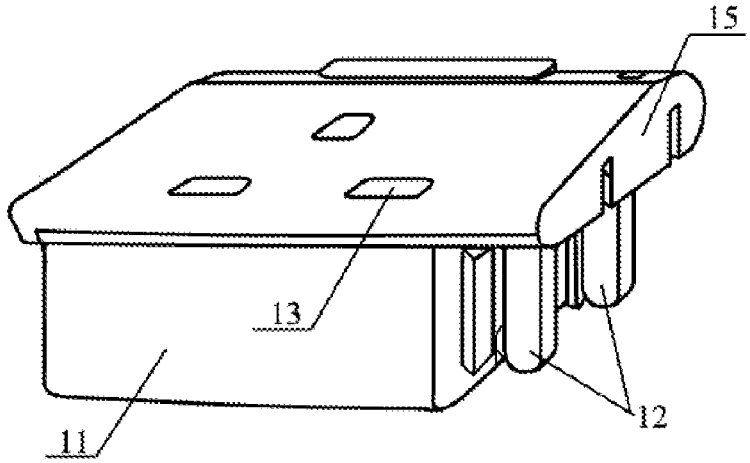
Figure 17A:
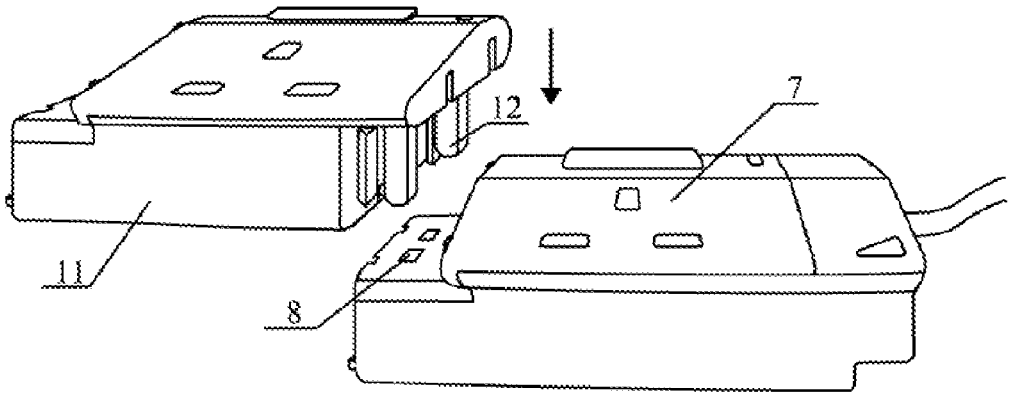
Figure 17B:
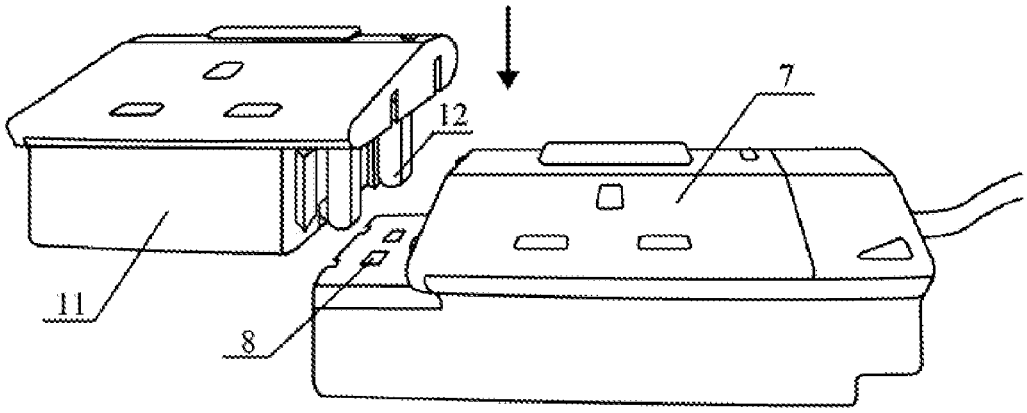
Figure 18:
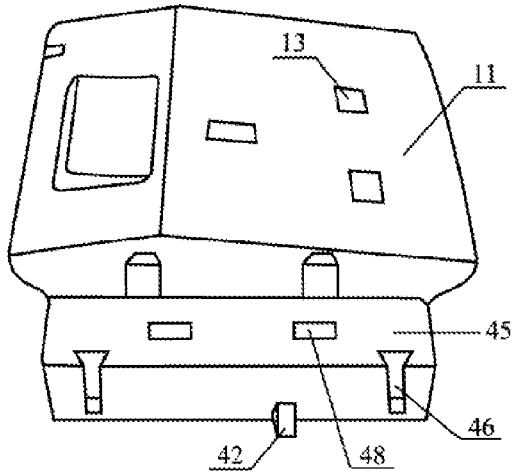
Figure 19:
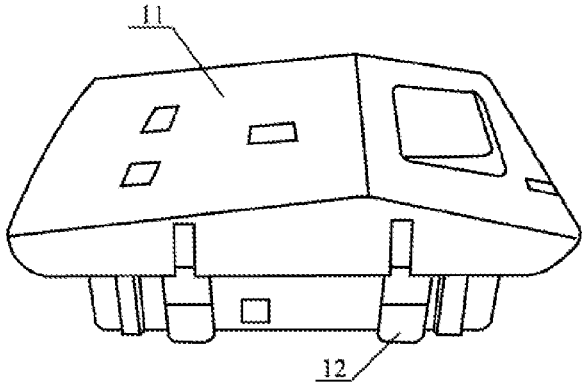
Figure 20:
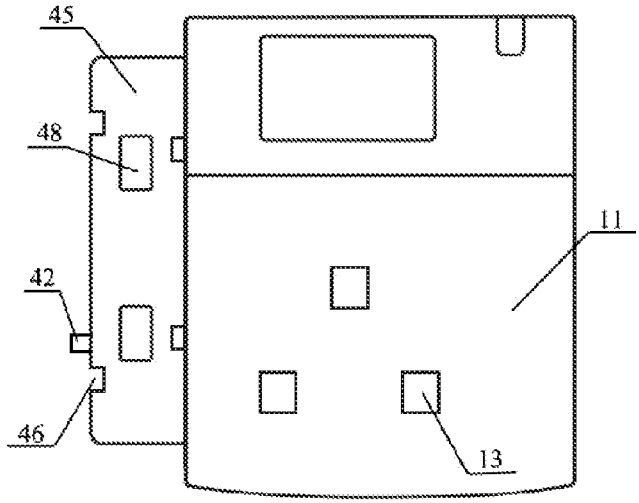
Figure 21:
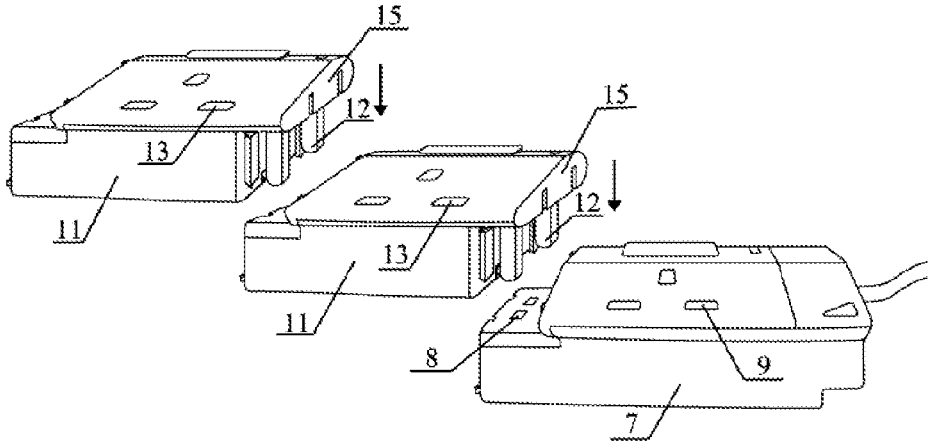
Figure 22:
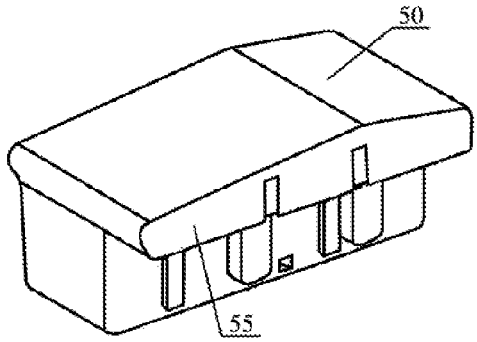
Figure 23:
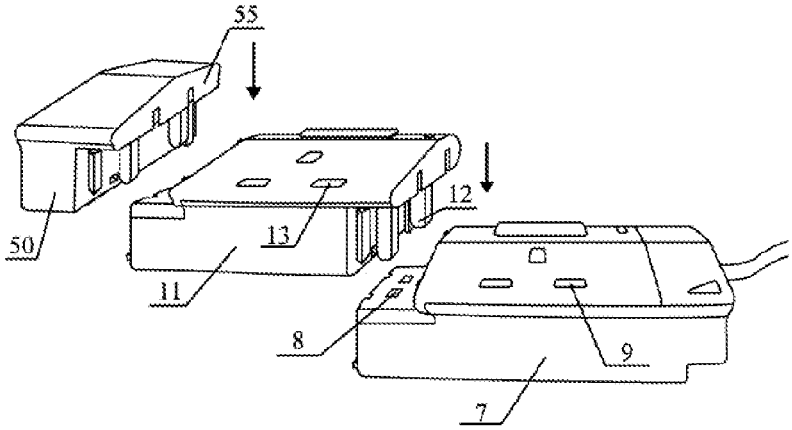

As shown in FIG. 14, a tough 53 may be formed on a vertical wall of the fourth stepped sidewall perpendicular to the base of the protective end piece 50 for receiving and engaging with the catch 42 of the extension socket 11 or the catch 22 of the power cord socket 7.

Furthermore, the protective end piece 50 can be connected to the power cord socket 7 or the extension socket 11 by slidable engagements. According to the illustrated embodiment depicted in FIG. 14, two vertical elongated grooves can be formed on a vertical wall of the fourth step portion 55 of the fourth stepped sidewall perpendicular to the face panel of the protective end piece 50, and two vertical elongated protrusions 59 can be formed on a vertical wall the fourth stepped sidewall perpendicular to the base of the protective end piece 50. This can facilitate the connection of the protective end piece 50 to the power cord socket 7 or the extension socket 11. When the protective end piece 50 is connected to the power cord socket 7 or the extension socket 11, the engaged grooves and protrusions help to prevent the protective end piece 50 from disengagement with the power cord socket 7 or the extension socket 11. It is understood that the side plug 52 may not be necessarily provided on the protective end piece 50 because the protective end piece 50 can be securely held in position by the grooves and protrusions connection between the protection end piece 50 and the power cord socket 7 or the extension socket 11.

Although it has been shown and described that the electrical connection of the power cord socket 7 and the extension sockets 11 is achieved by electric plugs and electric receptacles, it is understood by one skilled in the art that the electrical connection of the power cord socket 7 and the extension sockets 11 can be achieved by any other possible electrical connections such as electric metal pins, plates, bosses, springs, clips, etc.

Fourth Embodiment

Although it has been shown and described that the power cord socket 7, the extension sockets 11 and the protective end piece 50 are provided with three-prong plugs and three-prong receptacles, it is well understood that the power cord socket 7, the extension sockets 11 and the protective end piece 50 can be provided with plugs and sockets with more or less prongs.

FIGS. 15-23 show the fourth embodiment in which the power cord socket 7, the extension sockets 11 and the protective end piece 50 are provided with two-prong plugs and two-prong receptacles.

While the power strip disclosed in the present application has been shown and described with particular references to a number of preferred embodiments thereof, it should be noted that various other changes or modifications may be made without departing from the scope of the appending claims.

What is claimed is:

1. A socket kit for building a power strip, the socket kit comprising:

(a) a power cord socket comprising a face panel, a base and a first stepped sidewall defined by a first step portion extending along the base, a main electric receptacle provided on the face panel, a first electric connector provided on the first stepped sidewall, the main electric receptacle and the first electric connector being electrically coupled to a power cord; and (b) a extension socket comprising a face panel, a base and a second stepped sidewall defined by a second step portion extending along the face panel of the extension socket, the second stepped sidewall being formed at one side of the extension socket in an inverted configuration with respect to the first stepped sidewall, a main electric receptacle provided on the face panel of the extension socket, a second electric connector provided on the second stepped sidewall, the second electric connector being electrically coupled to the main electric receptacle of the extension socket, and connectable to the first electric connector of the power cord socket.

2. The socket kit as claimed in claim 1, wherein the extension socket further comprises a third stepped sidewall defined by a third step portion extending along the base of the extension socket and formed at another side of the extension socket, a third electric connector provided on the third stepped sidewall, the third electric connector being electrically coupled to the main electric receptacle of the extension socket, and connectable to the second electric connector of another extension socket.

3. The socket kit as claimed in claim 2, further comprising a protective end piece comprising a face panel, a base and a fourth stepped sidewall defined by a fourth step portion extending along the face panel of the protective end piece, the fourth stepped sidewall being formed in an inverted configuration with respect to the first or third stepped sidewall, a fourth connector provided on the fourth stepped sidewall, and connectable to the first electric connector of the power cord socket or the third electric connector of the extension socket.

4. A power strip comprising:

(a) a first socket comprising a face panel, a base and a first stepped sidewall defined by a first step portion extending along the base, a main electric receptacle provided on the face panel, a first electric connector provided on the first stepped sidewall, the main electric receptacle and the first electric connector being electrically coupled to a power cord; and (b) a second socket comprising a face panel, a base and a second stepped sidewall defined by a second step portion extending along the face panel of the second socket, the second stepped sidewall being formed at one side of the second socket in an inverted configuration with respect to the first stepped sidewall, a main electric receptacle provided on the face panel of the second socket, a second electric connector provided on the second stepped sidewall, the second electric connector being electrically coupled to the main electric receptacle of the second socket, and connectable to the first electric connector of the first socket.

5. The power strip as claimed in claim 4, wherein the second socket further comprises a third stepped sidewall defined by a third step portion extending along the base of the second socket and formed at another side of the second socket, a third electric connector provided on the third stepped sidewall, the third electric connector being electrically coupled to the main electric receptacle of the second socket, and connectable to the second electric connector of another second socket.

6. The power strip as claimed in claim 5, further comprising a protective end piece comprising a face panel, a base and a fourth stepped sidewall defined by a fourth step portion extending along the face panel of the protective end piece, the fourth stepped sidewall being formed in an inverted configuration with respect to the first or third stepped sidewall, a fourth connector provided on the fourth stepped sidewall, and connectable to the first electric connector of the first socket or the third electric connector of the second socket.

7. The power strip as claimed in claim 6, wherein the first electric connector is an electric receptacle provided on a receptacle-carrying wall of the first step portion generally facing the same direction as the face panel of the first socket, the second electric connector is an electric plug provided on a plug-carrying wall of the second step portion oppositely facing the face panel of the second socket, the third electric connector is an electric receptacle provided on a receptacle-carrying wall of the third step portion generally facing the same direction as the face panel of the second socket, and the fourth electric connector is a plug provided on a plug-carrying wall of the fourth step portion oppositely facing the face panel of the protective end piece, wherein the electric plug of the second socket and the plug of the protective end piece are insertable into the electric receptacle of the first or second sockets in a direction perpendicular to the base thereof.

8. The power strip as claimed in claim 7, wherein the side electric plug is perpendicular to the plug-carrying wall of the second socket.

9. The power strip as claimed in claim 7, wherein the side electric plug of the second socket is a 2-prong electric plug, and the side electric receptacle of the first socket is a 2-prong electric receptacle.

10. The power strip as claimed in claim 7, wherein the side electric plug of the second socket is a 3-prong electric plug, and the side electric receptacle of the first socket is a 3-prong electric receptacle.

11. The power strip as claimed in claim 7, wherein prongs of the side electric plug of the second socket are arranged in a row along the plug-carrying wall, and corresponding openings of the side electric receptacle of the first socket are arranged in a row along the receptacle-carrying wall.

12. The power strip as claimed in claim 7, wherein each of the first and third stepped sidewalls has a first wall perpendicular to the base connected thereto, and each of the inverted second and fourth stepped sidewalls has a mating second wall perpendicular to the base connected thereto; wherein each of the first and third stepped sidewalls has a third wall perpendicular to the face panel connected thereto, and each of the inverted second and fourth stepped sidewalls has a mating fourth wall perpendicular to the face panel connected thereto; and wherein the first, second, third and fourth walls are parallel to each other.

13. The power strip as claimed in claim 12, wherein one of the first and second walls is provided with a trough, and the other one of the first and second walls is provided with a projecting catch for insertion into and engagement with the trough.

14. The power strip as claimed in claim 12, wherein one of the third and fourth walls is provided with an elongated protrusion perpendicular to the face panel connected thereto, and the other one of the third and fourth walls is provided with an elongated groove perpendicular to the face panel connected thereto for slidable engagement with the elongated protrusion.

15. The power strip as claimed in claim 12, wherein one of the first and second walls is provided with an elongated protrusion perpendicular to the base connected thereto, and the other one of the first and second walls is provided with an elongated groove perpendicular to the base connected thereto for slidable engagement with the elongated protrusion.

16. The power strip as claimed in claim 15, wherein the elongated protrusions and grooves have a generally rectangular cross section.

17. The power strip as claimed in claim 15, wherein the elongated protrusions and grooves have a generally dovetail-shaped cross section.

18. A power strip formed of a plurality of connectable sockets, the power strip comprising:

(a) a power cord;

(b) a first socket comprising a face panel, a base and a first stepped sidewall defined by a first step portion extending along the base, a main electric receptacle provided on the face panel, a side electric receptacle provided on a receptacle-carrying wall of the first step portion generally facing the same direction as the face panel, the main and side electric receptacles being electrically coupled to the power cord; and (c) a second socket comprising a face panel, a base and a second stepped sidewall defined by a second step portion extending along the face panel of the second socket, the second stepped sidewall being formed at one side of the second socket in an inverted configuration with respect to the first stepped sidewall, a main electric receptacle provided on the face panel of the second socket, a side electric plug provided on a plug-carrying wall of the second step portion oppositely facing the face panel of the second socket, the side electric plug being electrically coupled to the main electric receptacle of the second socket;

wherein the side electric plug of the second socket is insertable into the side electric receptacle of the first socket in a direction perpendicular to the base thereof, thereby connecting the first and second sockets together.

19. The power strip as claimed in claim 18, wherein the second socket further comprises a third stepped sidewall defined by a third step portion extending along the base of the second socket and formed at another side of the second socket, a side electric receptacle provided on a receptacle-carrying wall of the third step portion generally facing the same direction as the face panel of the second socket, the side electric receptacle of the second socket being electrically coupled to the main electric receptacle of the second socket, and adapted to receive the side electric plug of another second socket.

20. The power strip as claimed in claim 19, further comprising a protective end piece, the protective end piece comprising a face panel, a base and a fourth stepped sidewall defined by a fourth step portion extending along the face panel of the protective end piece, the fourth stepped sidewall being formed in an inverted configuration with respect to the first or third stepped sidewall, a side plug provided on a plug-carrying wall of the fourth step portion oppositely facing the face panel of the protective end piece, the side plug of the protective end piece being insertable into the side electric receptacle of the first or second socket.

* * * * *